US006523359B1

(12) United States Patent
Posch

(10) Patent No.: US 6,523,359 B1
(45) Date of Patent: Feb. 25, 2003

(54) ENVIRONMENTAL CONTROL DEVICE

(75) Inventor: Robert Posch, Waterford, MI (US)

(73) Assignee: Environmental Pool Systems, Inc., Waterford, MI (US)

( * ) Notice: Subject to any disclaimer, the term of this patent is extended or adjusted under 35 U.S.C. 154(b) by 0 days.

(21) Appl. No.: 09/970,272

(22) Filed: Oct. 3, 2001

(51) Int. Cl.[7] ..... F25B 29/00
(52) U.S. Cl. ..... 62/173; 62/260; 62/186
(58) Field of Search ..... 62/173, 238.6, 62/238.7, 186, 260, 427, 419, 412, 413, 415, 414, 93

(56) References Cited

U.S. PATENT DOCUMENTS

RE22,100 E * 5/1942 Brace et al. ..... 257/3
2,907,178 A * 10/1959 McNatt ..... 62/238.7
4,271,678 A * 6/1981 Liebert ..... 62/173
4,796,437 A * 1/1989 James ..... 62/79
5,161,386 A * 11/1992 Higuchi ..... 62/160
5,243,825 A * 9/1993 Lin ..... 62/238.7
5,438,846 A * 8/1995 Datta ..... 62/238.7
6,321,546 B1 * 11/2001 Johnson et al. ..... 62/173

* cited by examiner

*Primary Examiner*—William C. Doerrler
(74) *Attorney, Agent, or Firm*—Young & Basile, P.C.

(57) ABSTRACT

A dehumidifier for swimming pool enclosures includes a first circuit having a condenser, an evaporator, and refrigerant, and a second circuit including the evaporator of the first circuit, a second evaporator and a heat sink fluid movable along the circuit. The second evaporator is positioned upstream with respect to the condenser of the first circuit. A bypass directs air around the second evaporator and a second bypass selectively directs air around both the second evaporator and the condenser.

17 Claims, 6 Drawing Sheets

ENVIRONMENTAL CONTROL DEVICE

FIELD OF THE INVENTION

The invention relates to a dehumidifier, and more specifically, the invention provides a dehumidifier for removing moisture from the air in a pool enclosure.

BACKGROUND OF THE INVENTION

Controlling indoor pool environments in a four season setting has been a costly and complicated job. While conventional ventilation systems and heat recovery systems appear to have a cost advantage over energy recycling equipment with respect to equipment cost, there are several problems associated with using a conventional ventilation system for a pool enclosure. First, a ventilation system works only when the humidity outside is substantially lower than the humidity on the inside. An indoor swimming pool can lose as much as 100 gallons of water through evaporation to the adjacent air every day. Traditional ventilation systems cannot remove this amount of moisture in a single day. Second, the operating cost of ventilation systems are higher in colder climates due to the need to heat winter air to an acceptable temperature for the enclosure. Outdoor air must be brought into the enclosure to decrease the humidity in the enclosure. Third, traditional ventilation systems will not control chlorine or eliminate chloramines in the air.

Excessive moisture in the air of the pool enclosure can cause several problems. The moist air encounters cooler surfaces such as windows, ceilings, or outdoor walls causing the air to cool and water to condense out of the cool air. The condensed water becomes a haven for fungus, mold and mildew which can contain potentially dangerous biotoxins. Furthermore, humid air is uncomfortable for any one in the swimming pool enclosure, except the swimmers. In addition, gaps in the ceiling or walls provide openings humid air to access building structural members. Condensation can cause water deposits to accumulate on structural members, unseen for years. These deposits can accelerate the deterioration of the structure.

One approach to dealing with the problem of humid air in a swimming pool enclosure has been to simply open the doors and windows of the enclosure and let external, relatively dryer air enter the enclosure. This "passive" approach, however, only works on days when the outdoor air is at the same temperature as the air in the enclosure and is of lower humidity. These conditions rarely exist. Furthermore, the passive approach results in substantial energy loss, since the humid air of the enclosure contains latent heat energy lost by the water of the pool.

A second approach for dealing with the problem of humid air in a swimming pool enclosure has been to provide a ventilation system. Exhaust fans remove humid air while external air is heated or cooled to a desired temperature and transmitted to the swimming pool enclosure. However, the heating, ventilation, and air conditioning (HVAC) equipment required to accomplish this is expensive and difficult to operate. Furthermore, the equipment typically consists of relatively large and noisy exhaust fans. This approach will not work to dehumidify the air when the outdoor air has the same level of humidity as the air in the swimming pool enclosure.

A third approach to solving the problem is referred to as "active dehumidification." In an active dehumidification system, a blower draws air from the swimming pool enclosure through a dehumidifier coil which is chilled to maintain a surface temperature lower than the dew point. Humidity in the air condenses on the coil and drains. Both sensible and latent heat energy is recaptured by the refrigerant flowing through the dehumidification coil. Refrigerant is drawn into a compressor, compressed and forwarded to a pool water heater. The pool water heater acts as a condenser; heat is transferred from the refrigerant to the pool water. Active dehumidification systems also can include an air reheat coil. Refrigerant exits the pool water heater and travels to the air reheat coil to transfer any remaining heat available to air passing through the system.

Existing active dehumidification systems have several shortcomings. First, existing systems are unable to modify operating conditions to maximize efficiency and capacity. Specifically, existing systems will continue to operate at maximum blower capacity even when efficiency of the system decreases. The capacity of the dehumidifier coil capacity is based on surface area, temperature, and the velocity of air passed over the coil. As air velocity increases, the temperature of the coil will increase, and the capacity of the coil decreases. Therefore, it would be desirable to maintain a constant coil temperature. In addition, existing active dehumidification systems generally include a dehumidifier coil having six or eight rows. The six and eight row evaporator coils are virtually impossible to clean and must be replaced when dirty. Since refrigerant is circulated through the evaporator coil, replacement of a coil requires highly trained personnel.

SUMMARY OF THE INVENTION

The present invention provides an apparatus and method for removing moisture from air. The invention includes a refrigerant circuit passing through a first heat exchanger and an evaporator portion of a second heat exchanger. The invention also includes a heat sink circuit passing through the first heat exchanger of the refrigerant circuit and a third heat exchanger. Refrigerant moves along a first path formed by the refrigerant circuit. The first heat exchanger is exposed to an air stream. Heat is transferred from the refrigerant to the air stream as it passes through the first heat exchanger. The evaporator portion of the second heat exchanger is exposed to a heat sink fluid stream moving along a second path formed by the heat sink circuit. Heat is transferred from the heat sink fluid stream to the refrigerant as it passes through the evaporator portion of the second heat exchanger. The heat sink fluid moves from the evaporator portion of the second heat exchanger to the third heat exchanger. The third heat exchanger is exposed to the air stream and is positioned upstream with respect to the first heat exchanger. Heat is transferred from the air stream to heat sink circuit. Water vapor in the air stream condenses on the third heat exchanger. The air stream moves from the third heat exchanger to the first heat exchanger and is heated.

The present invention also provides a method and apparatus for directing air around the third heat exchanger to maximize the efficiency of the system. The third heat exchanger and the first heat exchanger can be positioned in a conduit. The conduit can be divided into first, second and third chambers by the first and third heat exchangers. The first chamber can be defined within the conduit between the inlet of the conduit and the third heat exchanger. The second chamber can be defined within the conduit between the third heat exchanger and the first heat exchanger. The third chamber can be defined within the conduit between the outlet of the conduit and the first heat exchanger. The invention can include a second inlet communicating with the conduit adjacent the second chamber to allow a second air stream to bypass the third heat exchanger and enter the conduit. The second air stream entering the second inlet is mixed with the air stream that has passed across the evaporator portion of the third heat exchanger. The invention can include a damper for opening and closing the second inlet and controlling the amount of air bypassing the third heat exchanger. The invention can also include a third inlet communicating with the conduit adjacent the third chamber to allow a third air stream to bypass the third heat exchanger and the first heat exchanger.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
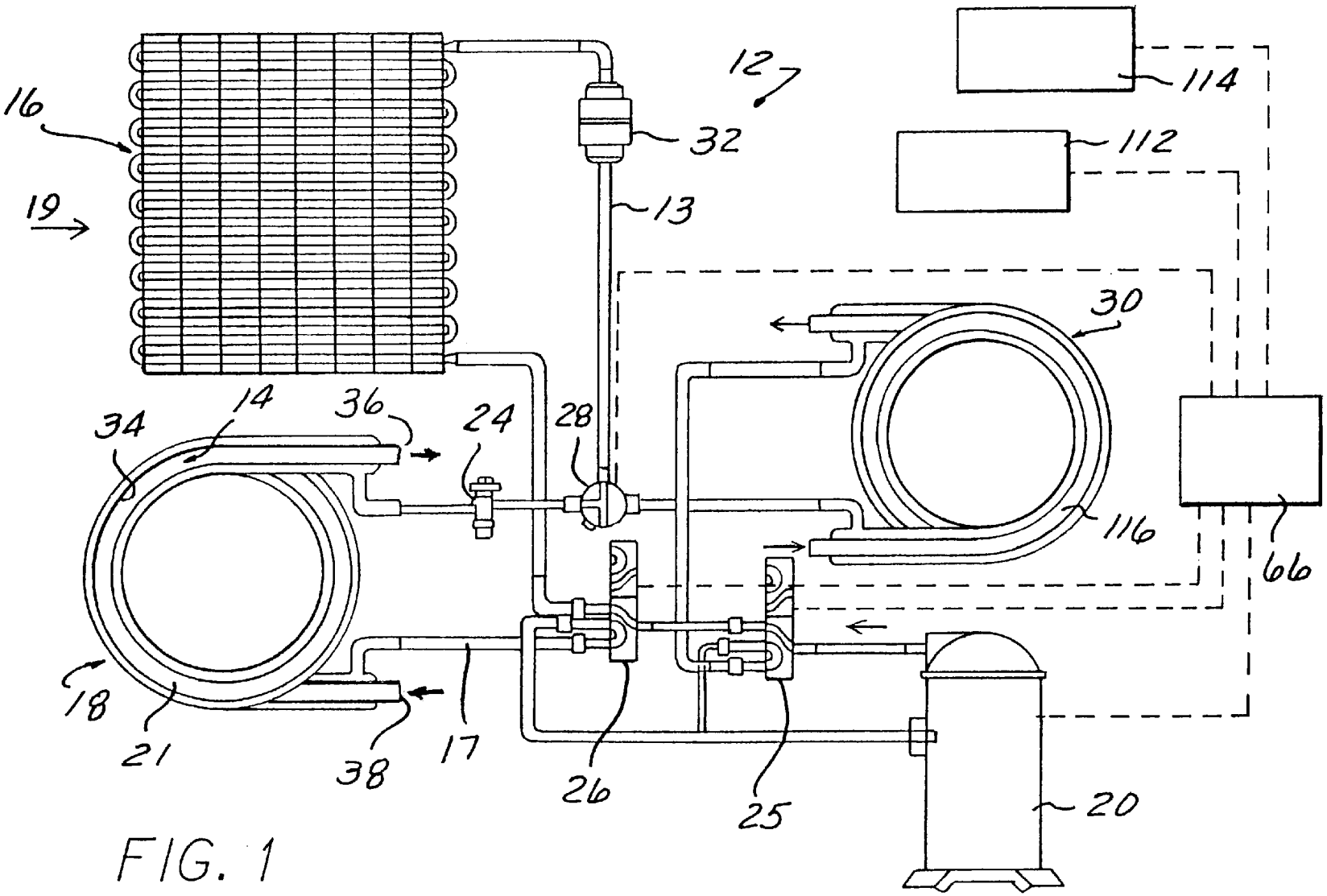
FIG. 1 is a schematic view of a refrigerant circuit according to the present invention operating in a first mode.

The present invention provides an environmental control device 10 for removing moisture from air. The invention includes a refrigerant circuit 12 and a heat sink circuit 14. A refrigerant circuit 12 is shown in FIG. 1 according to the present invention. The circuit 12 includes a first heat exchanger 16, a second heat exchanger 18, a compressor 20 and an expansion valve 24. The first heat exchanger 16 includes a condenser portion. The components of the circuit 12 are connected with piping to form a closed loop path 13. A refrigerant stream 17 moves along the path 13.

The refrigerant circuit can operate in several modes. In a first mode, the heat exchanger 16 acts as a condenser to condense vaporized refrigerant and transfer heat from the refrigerant stream 17 to an air stream 19, increasing the temperature of the air stream 19 flowing relative to the first heat exchanger 16. In the first mode, the refrigerant stream 17 is compressed by the compressor 20 and directed to the first heat exchanger 16 by a direction valve 25 in a first position and a reversing valve 26 in a first position. The direction valve 25 can be moved between two positions. The reversing valve 26 can be moved between two positions. The refrigerant stream 17 can move from the compressor 20, through the direction valve 25, and through the reversing valve 26 to enter the first heat exchanger 16.

Refrigerant in the form of high pressure vapor transfers heat to an airstream 19 flowing across the first heat exchanger 16 to increase the temperature of the airstream 19. After passing through the first heat exchanger 16, the refrigerant stream 17 moves through a three-way valve 28, the expansion valve 24 and enters the second heat exchanger 18. The second heat exchanger 18 includes a heat transfer wall 34 separating the refrigerant stream 17 from a water stream 21. The water stream 21 moves along the heat sink circuit 14. The water stream 21 enters the second heat exchanger 18 at an inlet 38 and exits the second heat exchanger 18 at an outlet 36. Heat is transferred from the water stream 21 to the refrigerant stream 17 passing through the second heat exchanger 18, through the wall 34. The refrigerant stream 17 moves to the compressor 20 to be compressed after passing through the second heat exchanger 18.

Figure 2:
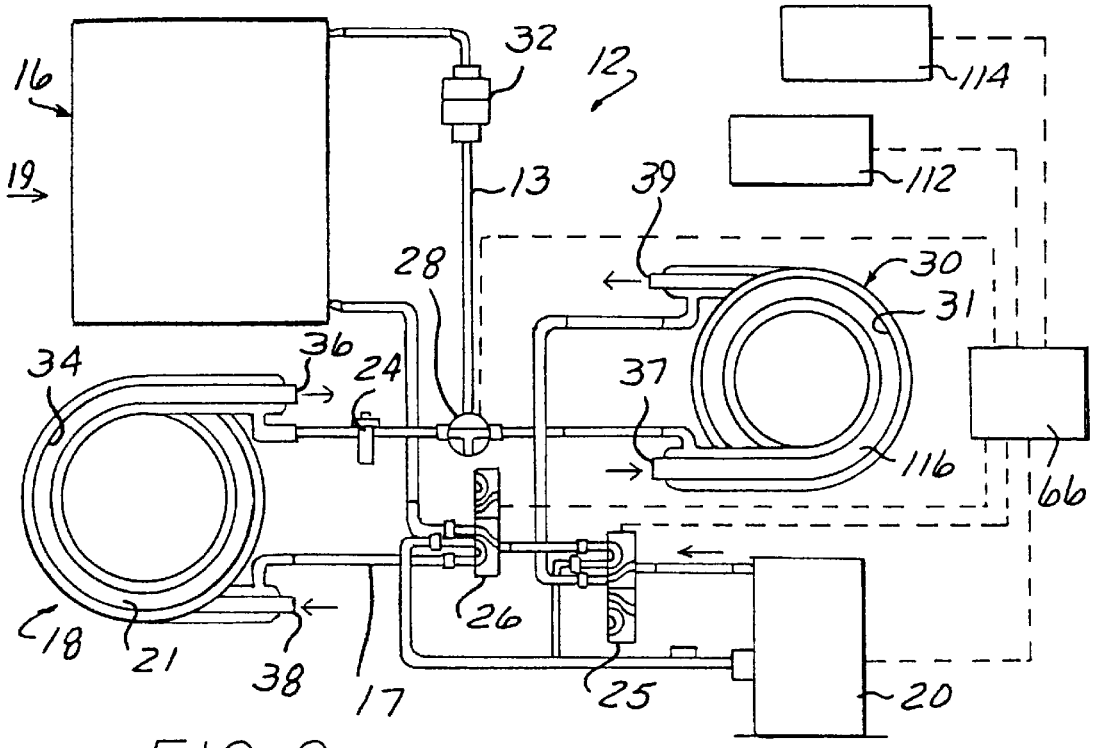
FIG. 2 is a schematic view of a refrigerant circuit according to the present invention operating in a second mode.

Referring now to FIG. 2, in a second mode of operation of the refrigerant circuit, the direction valve 25 can be moved to a second position and the reversing valve 26 remains in the first position. The refrigerant stream 17 can move from the compressor 20 and through the direction valve 25 to a fourth heat exchanger 30. The fourth heat exchanger 30 includes a heat transfer wall 31 separating the refrigerant stream 17 from a water stream 116. The water stream 116 enters the fourth heat exchanger at an inlet 37 and exits the fourth heat exchanger 30 at an outlet 39. Heat is transferred from the refrigerant stream 17 to the water stream 116 passing through the fourth heat exchanger 30 through the wall 31. The hot or heated water stream 116 can be directed to a swimming pool after passing through the fourth heat exchanger 30. The refrigerant stream 17 moves through the three-way valve 28, the expansion valve 24 and enters the second heat exchanger 18 after passing through the fourth heat exchanger 30. The second heat exchanger 18 includes a heat transfer wall 34 separating the refrigerant stream 17 from a water stream 21. The water stream 21 moves along the heat sink circuit 14. The water stream 21 enters the second heat exchanger 18 at an inlet 38 and exits the second heat exchanger 18 at an outlet 36. Heat is transferred from the water stream 21 to the refrigerant stream 17 passing through the second heat exchanger 18 through the wall 34. The refrigerant stream 17 moves to the compressor 20 to be compressed after passing through the second heat exchanger 18.

Figure 3:
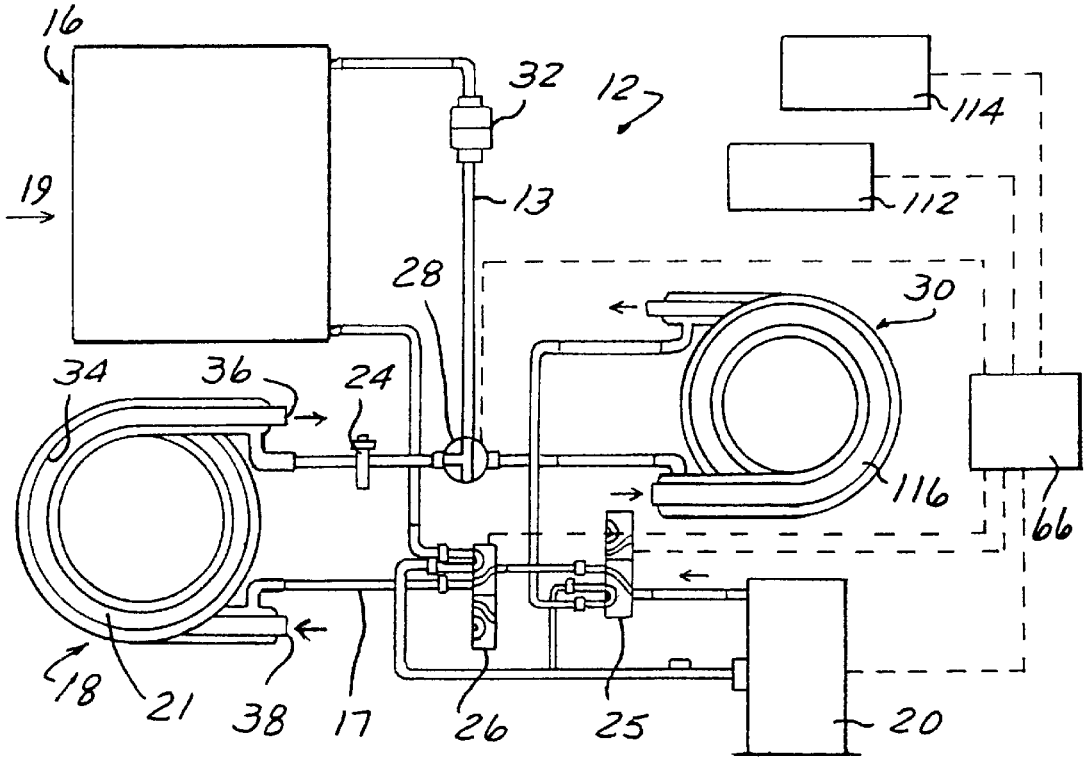
FIG. 3 is a schematic view of a refrigerant circuit according to the present invention operating in a third mode.

Referring now to FIG. 3, in a third mode of operation of the refrigerant circuit, the direction valve 25 is in the first position and the reversing valve 26 is in a second position. The refrigerant stream 17 can move from the compressor 20, through the direction valve 25, and through the reversing valve 26 to enter the second heat exchanger 18. In the third mode of operation of the refrigerant circuit, the second heat exchanger 18 acts as a condenser to condense the refrigerant stream 17 by transferring heat to the water stream 21 to increase the temperature of the water stream 21. The second heat exchanger 18 includes a heat transfer wall 34 separating the refrigerant stream 17 from a water stream 21. The water stream 21 moves along the heat sink circuit 14. The water stream 21 enters the second heat exchanger 18 at an inlet 38 and exits the second heat exchanger 18 at an outlet 36. Heat is transferred from the refrigerant stream 17 to the water stream 21 passing through the second heat exchanger 18, through the wall 34. The refrigerant stream 17 moves through the expansion valve 24, the three-way valve 28 and enters the first heat exchanger 16. In the third mode of operation of the refrigerant circuit 12, the first heat exchanger 16 acts as an evaporator to evaporate the refrigerant stream 17 to transfer heat to the refrigerant stream 17 to decrease the temperature of the air stream 19 flowing relative to the first heat exchanger 16. The refrigerant stream 17 passes through the reversing valve 26 and enters the compressor 20 to be compressed after passing through the first heat exchanger 16.

Figure 4:
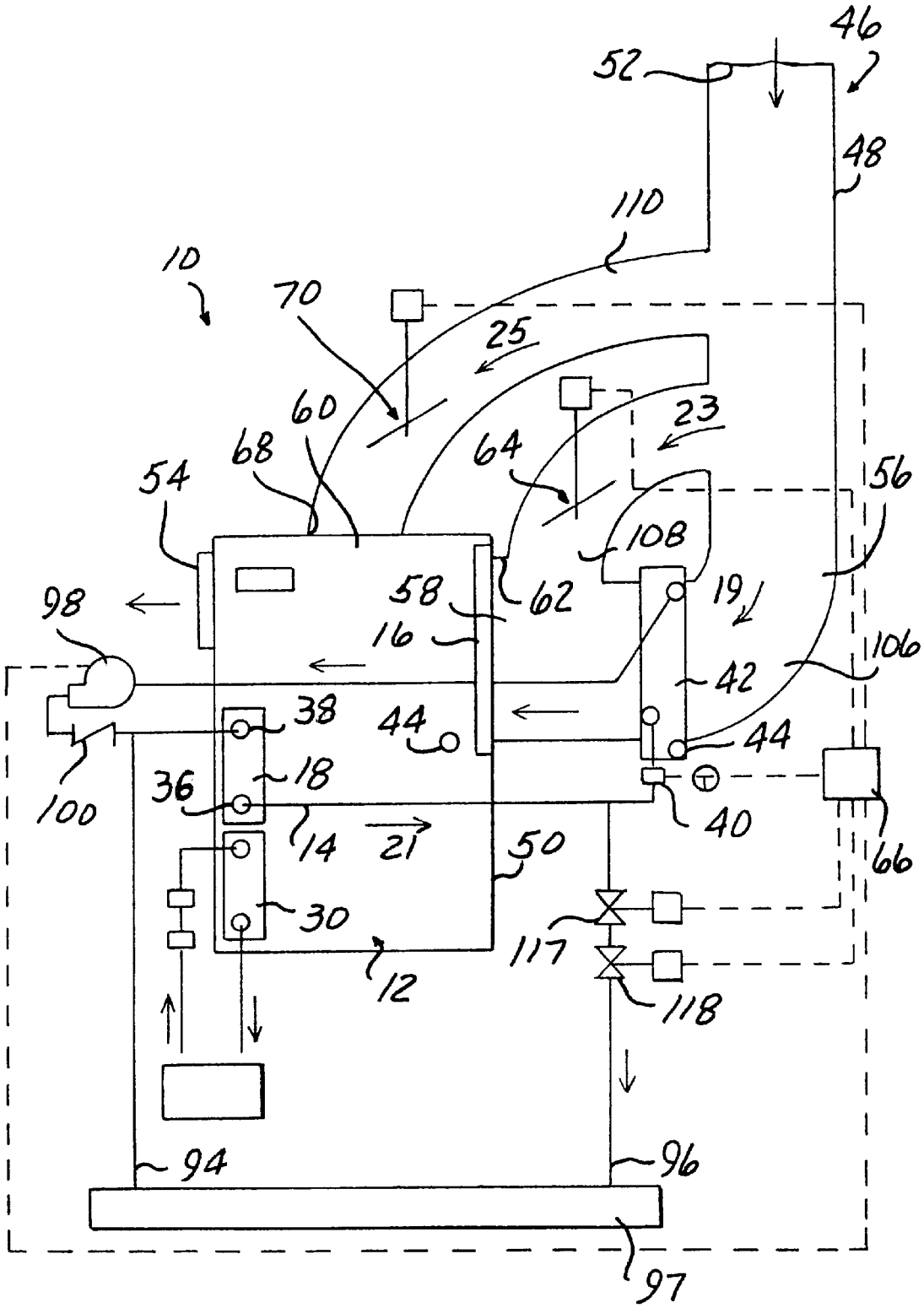
FIG. 4 is a schematic view of the environmental control device including an external heat sink fluid stream source according to the present invention.

Referring now to FIG. 4, the water stream 21 moves from the second heat exchanger 18 along a second path defined by the heat sink circuit 14. The heat sink circuit 14 includes the inlet 38, the second heat exchanger 18, the outlet 36, a temperature sensor 40 and a third heat exchanger 42. The circuit 14 also includes appropriate piping to form a closed loop path between the second heat exchanger 18 and the third heat exchanger 42. The chilled water stream 21 leaving the outlet 36 has a lower temperature relative to the water stream 21 entering the inlet 38. The water stream 21 travels along the heat sink circuit 14 to the sensor 40 for measuring a temperature of the water stream 21. The sensor 40 can be in communication with a controller 66.

The water stream 21 enters the third heat exchanger 42 from the outlet 36. The third heat exchanger 42 can include a coil having three or four rows. The air stream 19 passes across the third heat exchanger 42 and heat is transferred from the air stream 19 to the water stream 21 causing water to condense from the airstream 19. The air stream 19 is cooled at the third heat exchanger 42. The condensed water can drain from the third heat exchanger 42 through drain 44. The water stream 21 moves from the third heat exchanger 42 to the second heat exchanger 18. The air stream 19 passes across the first heat exchanger 16 after passing across the third heat exchanger 42. The air stream 19 is heated at the first heat exchanger 16 when the refrigerant circuit 12 is operating in the first mode.

The present invention can also include a conduit 46. As shown in FIG. 4, the conduit 46 is formed of a first portion 48 and a second portion 50. The conduit 46 includes an inlet 52 and an outlet 54. The inlet 52 receives the air stream 19 and the outlet 54 expels the air stream 19. The conduit 46 also includes a first chamber 56, a second chamber 58 and a third chamber 60. The first chamber 56 is positioned between the inlet 52 and the third heat exchanger 42. The second chamber 58 is positioned between the third heat exchanger 42 and the first heat exchanger 16. The third chamber 60 is positioned between the outlet 54 and the first heat exchanger 16.

The conduit 46 also includes a second inlet 62. The inlet 62 communicates with the conduit 46 adjacent the second chamber 58. A second air stream 23 can enter the conduit 46 through the inlet 62 and bypass the third heat exchanger 42. Bypassing at least a portion of the air stream 19 around the third heat exchanger 42 can be desirable when the third heat exchanger 42 exceeds a predetermined temperature sufficient to cause condensation of water vapor in the air stream 19. As the temperature of the third heat exchanger 42 increases, the capacity and efficiency of the third heat exchanger 42 can decrease. Bypassing at least part of the air stream 19 can return the operating temperature of the third heat exchanger 42 to below an upper threshold value.

The operating temperature of the third heat exchanger 42 can be monitored by monitoring the temperature of the water stream 21 with the sensor 40. As the circuit 14 operates over time, the temperature of the water stream 21 can increase based on the capacity and efficiency of the system. In particular, the amount of heat absorbed by the water stream 21 at the third heat exchanger 42 may not be completely transferred to the refrigerant stream 17 at the second heat exchanger 18. If a net heat gain occurs, the temperature of the water stream 21 will increase and will cause the temperature of the third heat exchanger 42 to increase. As the temperature of the third heat exchanger 42 increases, the efficiency of the third heat exchanger 42 will decrease and less humidity will condensate on the third heat exchanger 42. Therefore, it is desirable in the present invention to reduce the likelihood that the temperature of the water stream 21 will increase. An air stream 23 can be received in the second chamber 58 to reduce the flow rate of air stream 19 passing relative to the third heat exchanger 42 if the temperature of the water stream 21 increases. Reducing the flow rate of air stream 19 will reduce the thermal load of the third heat exchanger 42 while being less efficient in removing water vapor from the combined air stream. In other words, the temperature of the water stream 21 is monitored to ensure that the temperature is maintained below the dew point of the air stream 19.

The invention can also include a damper 64 for controlling the air stream 23 entering the second chamber 58 of the conduit 46 through the inlet 62. The damper 64 can be moveable to a plurality of positions between an open position and a closed position, for generating a range of airflows through the inlet 62. The controller 66 can control the damper 64 to move in response to the temperature of the water stream 21 entering the third heat exchanger 42. In operation, the sensor 40 senses the temperature of the water stream 21 entering the third heat exchanger 42 and emits a signal to the controller 66 corresponding to the temperature of the water stream 21. As the temperature of the water stream 21 increases, the controller 66 can move the damper 64 from a relatively closed position to a more open position to increase the flow rate of the air stream 23 bypassing the third heat exchanger 42.

The conduit 46 can also include a third inlet 68. The third inlet 68 communicates with the conduit 46 adjacent the third chamber 60. A third airstream 25 can enter the third chamber 60 through the inlet 68 to bypass both the third heat exchanger 42 and the first heat exchanger 16. If the temperature of the water stream 21 increases after the damper 64 has been moved to the open position, the third air stream 25 can be received by the third chamber 60 to bypass both the third heat exchanger 42 and the first heat exchanger 16. The invention can also include a damper 70 for controlling the air stream 25 entering the third chamber 60 of the conduit 46 through the inlet 68. The damper 70 can be moveable to a plurality of positions between an open position and a closed position for generating a range of airflows through the inlet 68. The controller 66 can control the damper 70 to move in response to the temperature of the water stream 21. In operation, the sensor 40 senses the temperature of the water stream 21 entering the third heat exchanger 42 and emits a signal to the controller 66 corresponding to the temperature of the water. As the temperature of the water stream 21 increases, the controller 66 can move the damper 70 from a relatively closed position to a more open position to increase flow rate of the air stream 23 bypassing the third heat exchanger 42. By diverting air around the third heat exchanger 42, the temperature of the third heat exchanger 42 will be less likely to increase beyond the upper threshold value sufficient to cause condensation of water vapor in the air stream 19.

FIG. 4 shows a first portion 48 of a conduit 46 having a common inlet 52 and a plurality of conduits 106, 108 and 110 extending from the inlet 52 to the third heat exchanger 42, the inlet 62 and the inlet 68, respectively. However, the conduit 46 can be formed as a single conduit 106 having apertures forming inlets 62 and 68 without conduits 108 and 110 if desired. The embodiment of the invention as shown in FIG. 4 is illustrative and not restrictive.

Figure 5:
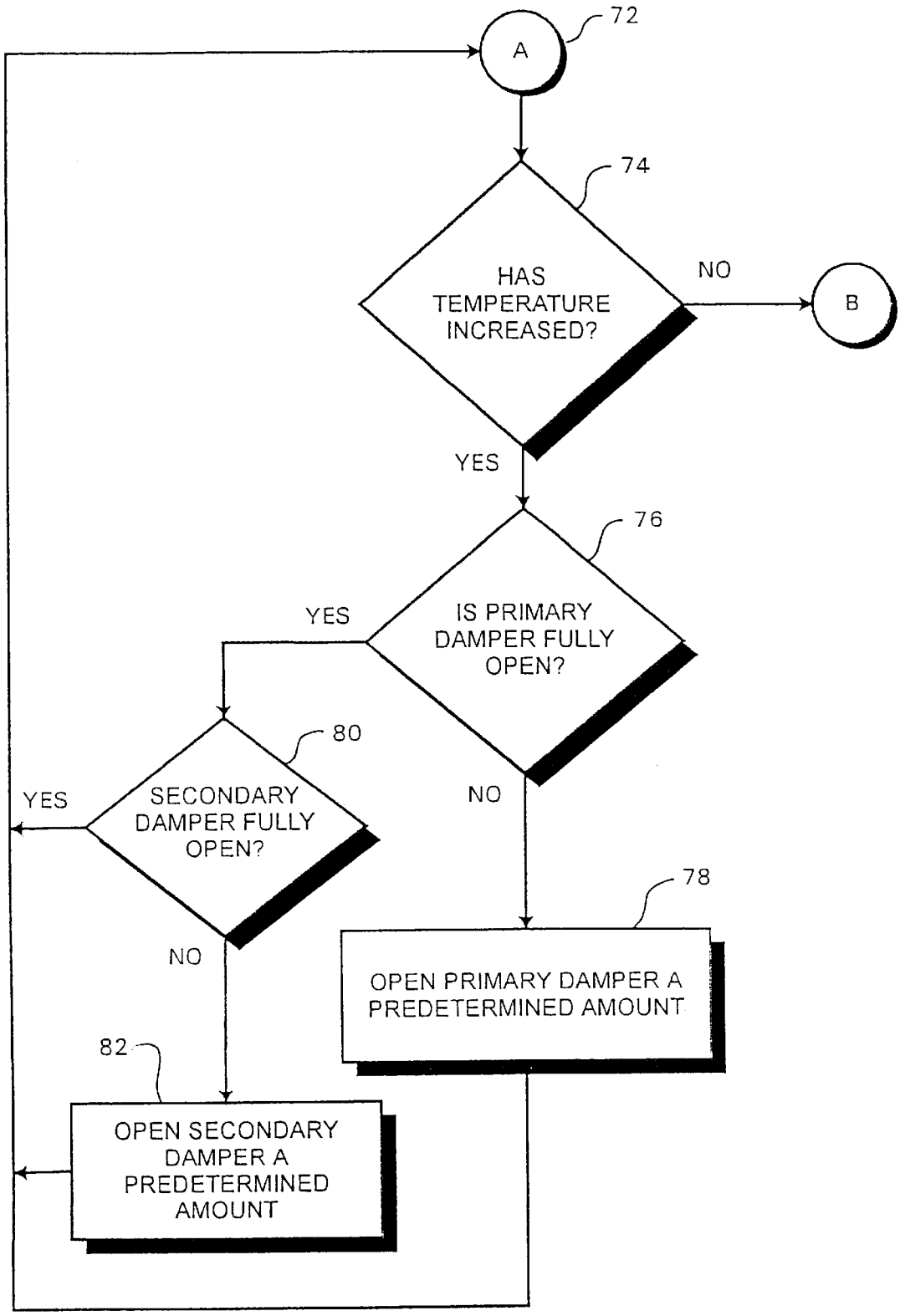
FIG. 5 is a flow diagram illustrating the steps for opening a pair of dampers according to the present invention.

The simplified flow diagram of FIG. 5 shows the steps for opening the dampers 64 and 70 with the sensor 40 and the controller 66. The process starts at step 72. Step 74 monitors the temperature of the water stream 21 entering the third heat exchanger 42. If the temperature has increased, the process continues to step 76 as shown in FIG. 5. Step 76 monitors whether the primary damper 64 is in the open position. If the primary damper 64 is not in the fully open position, step 78 opens the primary damper 64 a predetermined amount. The primary damper 64 can be moved incrementally to the fully open position when a temperature increase is detected by the controller 66 or can be moved to a proportional position between the open and closed positions depending on the magnitude of the temperature variance from the upper threshold value. If the primary damper 64 is in the fully open position when monitored at step 76, step 80 monitors whether the secondary damper 70 is in the fully open position. If the secondary damper 70 is in the fully open position, the process returns to step 74. If the secondary damper 70 is not in the fully open position, step 82 incrementally opens the secondary damper 70 a predetermined amount. The secondary damper 70 can be moved to the fully open position at step 82 by the controller 66 or can be moved incrementally or proportionally moved to a position between the open and closed positions depending on the magnitude of the temperature variance from the upper threshold value. The process returns to step 72 after step 82. If both dampers 64 and 70 are in the fully open position, a maximum amount of air is being bypassed with respect to the third heat exchanger 42 and the first heat exchanger 16.

Figure 6:
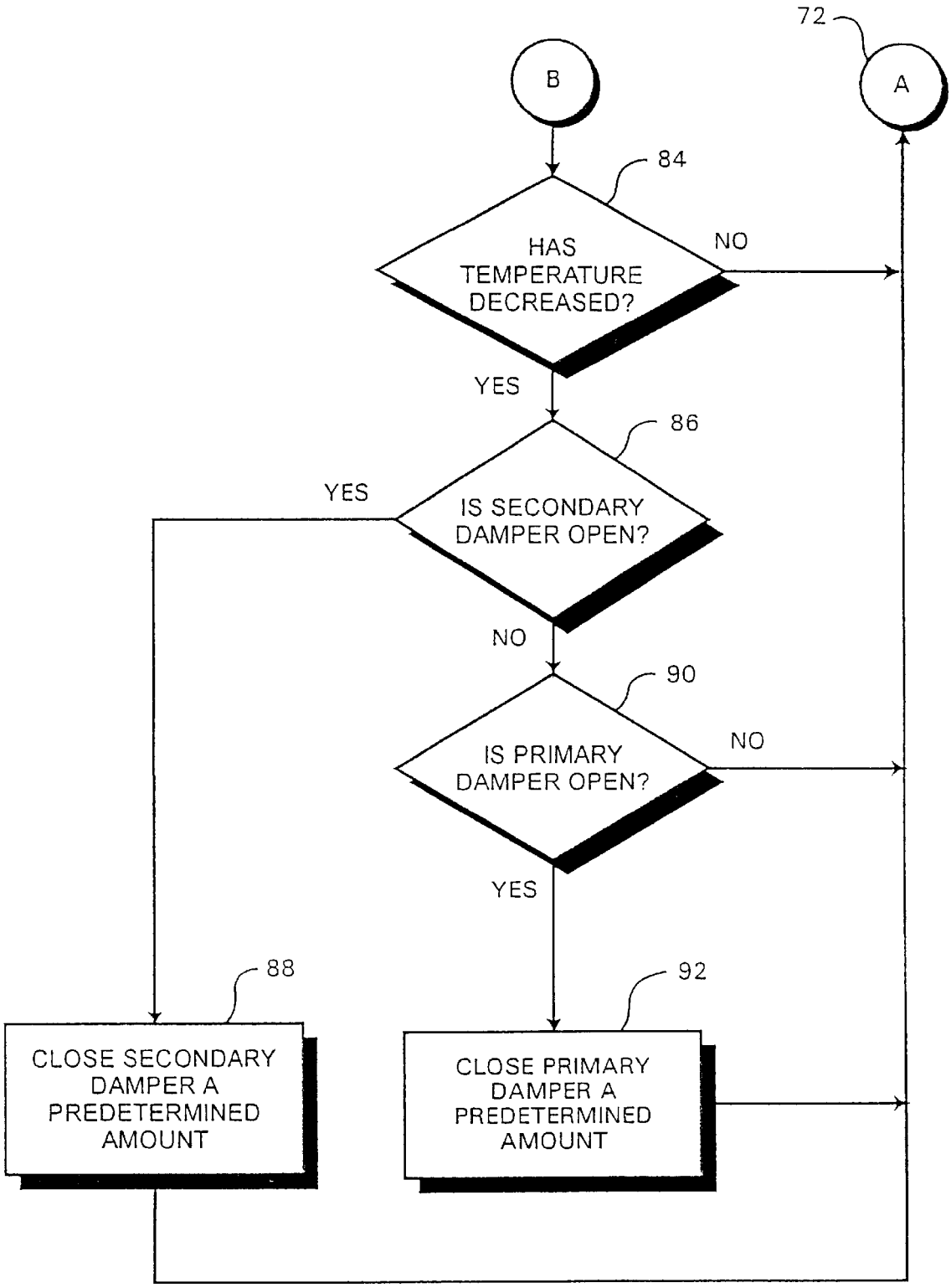
FIG. 6 is a flow diagram illustrating the steps for closing a pair of dampers according to the present invention.

The simplified flow diagram of FIG. 6 shows the steps for closing the dampers 64 and 70 with the sensor 40 and the controller 66. With reference to FIGS. 5 and 6, if the temperature of the water has not increased at step 74, step 84 monitors whether the temperature of the water stream has decreased. If the temperature has not decreased, the process returns to step 72. Whether the temperature has decreased can be determined based on a preferred temperature or an upper threshold temperature and a lower threshold temperature. The controller can be programmable for the threshold value of temperature of the water stream. The temperature can be selected based on the temperature of water entering the circuit, such as water drawn from a geothermal source.

If the temperature has decreased at step 84, step 86 monitors whether the secondary damper is at least partially open. If the secondary damper is at least partially open, the process continues to step 88 and the secondary damper is incrementally closed a predetermined amount. The predetermined amount can be completely closed or partially closed or proportionally closed depending on the magnitude of the temperature variance from the threshold value. If the secondary damper is not at least partially open when monitored at step 86, the process continues to step 90. Step 90 monitors whether the primary damper is at least partially open. If the primary damper is not at least partially open, the process returns to step 72. If the primary damper is at least partially open when monitored at step 90, the process continues to step 92. Step 92 incrementally closes the primary damper a predetermined amount. The predetermined amount can be fully closed or partially closed or proportionally controlled depending on the magnitude of the temperature variance from the threshold value. The process then returns to step 72. As the temperature of the water entering the third heat exchanger increases, the efficiency and the dehumidification capacity of the third heat exchanger decreases. The temperature of the water stream can increase as the system operates over a period of time depending on the refrigeration capacity of the refrigerant circuit.

The invention can include a blower 112, as shown in FIG. 1. The blower 112 can direct the air stream 19 across the first heat exchanger 16 and can direct the air stream 19 across the third heat exchanger 42, as shown in FIG. 4. The blower 112 can be operated by the controller 66 in accordance with a control program stored in memory. The controller 66 can control the blower 112 to generate a forced air stream 19. The circuit 12 can also include a heater 114. The heater 114 can generate heat to be transferred to the air stream 19. The heater 114 can be operated by the controller 66 in accordance with a control program stored in memory to control the operation of the heater 114. The circuit 12 can also include a filter 32 for the refrigerant.

As shown in FIG. 4, the second circuit 14 can receive water from an external source 97, shown schematically. The second circuit 14 can include an inlet 94 and an outlet 96 in communication with the source 97. The source 97 can be an open loop geothermal source, a closed loop geothermal source, or a boiler/cooling tower. The heat sink circuit 14 can also include a pump 98 for moving the water stream 21 along the heat sink circuit 14. The heat sink circuit 14 can also include a check valve 100 to control the flow of the water stream 21 and prevent backflow with respect to the pump 98. The pump 98 can be operated by the controller 66 in accordance with a control program stored in memory. The heat sink circuit 14 can include a solenoid valve 117 and a flow controller 118. The valve 117 can be opened to discharge water from the source 97 into the heat sink circuit 14, or closed to prevent water from leaving the heat sink circuit 14 through outlet 96. The flow controller 118 can be adjusted to control an exiting flow rate of the water stream 21. When valve 117 is closed and check valve or back-flow preventer 100 is open water will be circulated through the heat sink circuit 14 by operation of pump 98.

Figure 7:
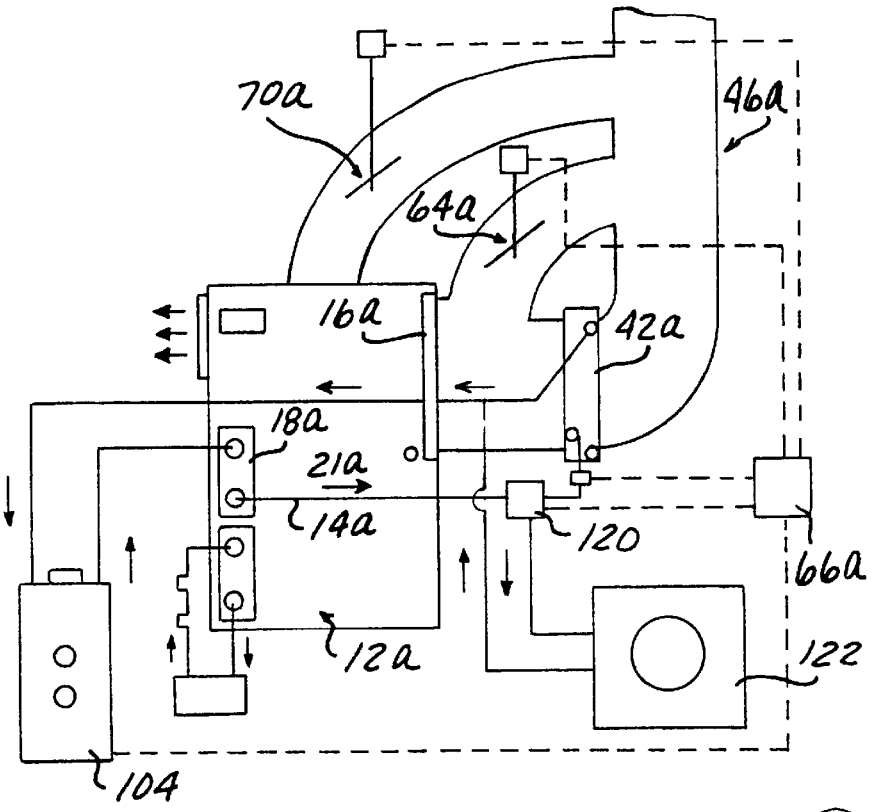
FIG. 7 is a schematic view of an environmental control device including an alternative water and glycol heat sink circuit according to the present invention.

Referring now to FIG. 7, the heat sink circuit 14*a* can include a hydronic pump 104 for moving a mixture of water and glycol along the heat sink circuit 14*a*. The hydronic pump 104 can be controlled by the controller 66*a*. The heat sink circuit 14*a* can include a valve 120 to divert the water/glycol stream 21*a* from the third heat exchanger 42*a* to a fifth heat exchanger 122. The fifth heat exchanger 122 can transfer heat from the water stream 21*a* or transfer heat to the water/glycol stream 21*a*. The other components illustrated in FIG. 7, namely refrigerant circuit 12*a*, first heat exchanger 16*a*, second heat exchanger 18*a*, conduit 46*a*, and dampers 64*a* and 70*a*, are operated as previously described with respect to FIGS. 1–6 except for the changes as noted.

Figure 8:
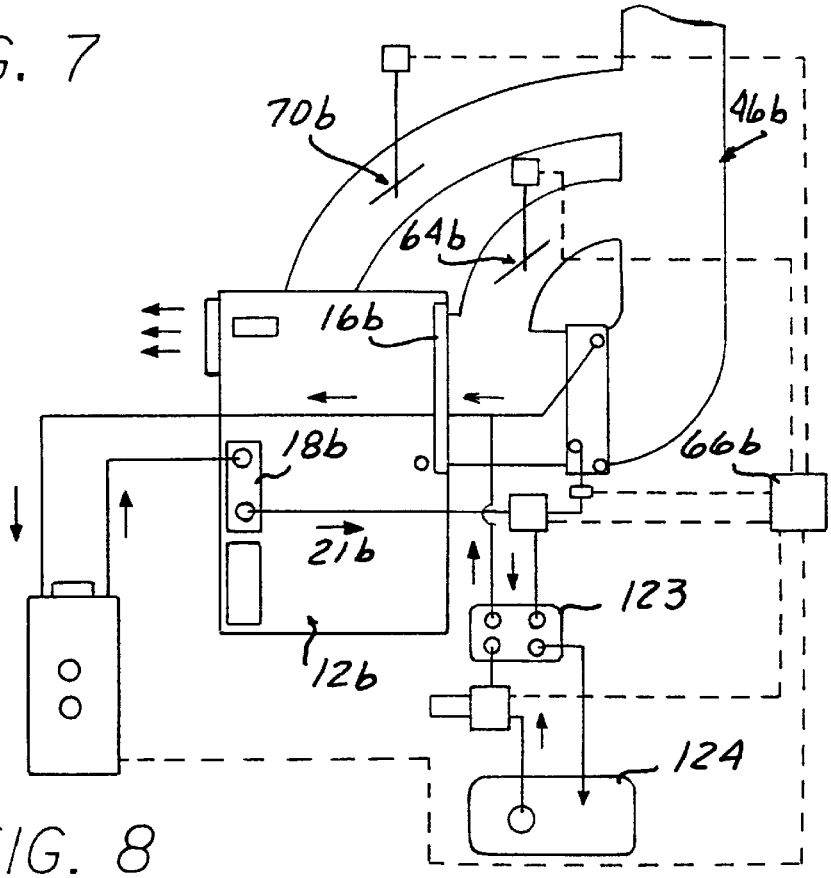
FIG. 8 is a schematic view of an environmental control device including an optional swimming pool water heater according to the present invention.

Referring now to FIG. 8, a fifth heat exchanger 123 can transfer heat from the water stream 21*b* to water from a swimming pool 124. The other components illustrated in FIG. 8, namely refrigerant circuit 12*b*, first heat exchanger 16*b*, second heat exchanger 18*b*, conduit 46*b*, and dampers 64*b* and 70*b*, are operated as previously described with respect to FIGS. 1–6 except for the changes as noted.

The apparatus dehumidifies the airstream 19 while the refrigerant circuit 12 is operated in the first mode. The blower 112 can generate the airstream 19 across the third heat exchanger 42 and the first heat exchanger 16. The pump 98 (shown in FIG. 4) pumps the water stream 21 through the heat sink circuit 14. The water stream 21 is directed through the third heat exchanger 42. In an alternative embodiment of the invention, pump 104 (shown in FIG. 7) pumps the water/glycol stream 21*a* through the heat sink circuit 14*a*. Valve 120 can be selectively switched to direct the water/glycol stream 21*a* through the third heat exchanger 42*a* or the fifth heat exchanger 122. As shown in FIG. 1, the refrigerant circuit 12 can include a heater 114. The heater 114 can be operated to heat the air stream 19 after water vapor has been removed from the air stream 19 prior to discharge into the pool area.

The apparatus can be used to heat the airstream 19 without removing water vapor from the air stream 19 while the refrigerant circuit 12 is operated in the first mode. The blower 112 generates the airstream 19 across the third heat exchanger 42 and the first heat exchanger 16. The pump 98 (shown in FIG. 4) is disengaged and solenoid valve 117 is opened to discharge the water stream 21 out of the outlet 96. The air stream 19 can be heated by passing across the first heat exchanger 16. The heater 114 can be engaged to further heat the air stream 19.

The apparatus can be used to heat the water stream 116 and remove water vapor from the air stream 19 while the refrigerant circuit 12 is operated in the second mode. The blower 112 generates the airstream 19 across the first heat exchanger 16 and the third heat exchanger 42. The pump 98 (shown in FIG. 4) pumps the water stream 21 through the heat sink circuit 14 and solenoid valve 117 is closed. Water vapor will be removed from the air stream 19 at the third heat exchanger 42. The heater 114 can be operated to further heat the air stream 19 after water vapor has been removed from the air stream 19 in the third heat exchanger 42 and the air stream 19 has been preheated by passing through first heat exchanger 16.

The apparatus can be used to cool and dehumidify the airstream 19 while the refrigerant circuit 12 is operated in the third mode. The blower 112 generates the airstream 19 across the first heat exchanger 16 and the third heat exchanger 42. The pump 98 (shown in FIG. 4) is disengaged and solenoid valve 117 is opened to discharge the water stream 21 out of the outlet 96. The air stream 19 can be cooled and water vapor can be removed from the air stream 19 by passing across the first heat exchanger 16.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for removing moisture from air comprising:

a refrigerant circuit including a first heat exchanger, a second heat exchanger, and a refrigerant stream movable along a first path between the first and second heat exchangers, the first heat exchanger operable in a first mode to transfer heat from the refrigerant stream to increase a temperature of an air stream flowing relative to the first heat exchanger;

a heat sink circuit including the second heat exchanger, a third heat exchanger, and a heat sink fluid stream movable along a second path from the second heat exchanger to the third heat exchanger, the second heat exchanger operable when in a first mode to transfer heat from the heat sink fluid stream to the refrigerant stream and for decreasing a temperature of the heat sink fluid stream, the third heat exchanger operable to receive the heat sink fluid stream from the second heat exchanger to transfer heat from the air stream adjacent the third heat exchanger to the heat sink fluid stream to condense water vapor in the air on the third heat exchanger, the third heat exchanger positioned upstream with respect to the air stream through the first heat exchanger when operating in the first mode;

a conduit including an inlet and an outlet for the air stream, the third heat exchanger positionable in the conduit downstream of the inlet to define a first chamber therebetween, the first heat exchanger positionable in the conduit downstream of the third heat exchanger to define a second chamber therebetween, the conduit also including a second inlet communicating with the second chamber for introducing a second air stream to the second chamber to bypass the third heat exchanger; and means for controlling a flow of the second air stream through the second inlet, the controlling means operable with respect to the second inlet between an opened position and a closed position, the opened position corresponding to a minimal restriction of the flow and the closed position corresponding to a maximum restriction of the flow.

2. The apparatus of claim 1 wherein the controlling means further comprises:

a sensor for sensing a condition corresponding to a temperature of the heat sink fluid received by the third heat exchanger and emitting a signal corresponding to the sensed temperature.

3. The apparatus of claim 2 wherein the controlling means further comprises:

an actuator for receiving the signal from the sensor and moving a damper operably associated with the second inlet.

4. The apparatus of claim 1 further comprising:

the heat sink fluid stream supplied from a geothermal source.

5. The apparatus of claim 4 further comprising:

the geothermal source including an open loop geothermal circuit.

6. The apparatus of claim 5 further comprising:

the heat sink circuit including a valve to close the heat sink circuit with respect to the geothermal source.

7. The apparatus of claim 4 further comprising:

the geothermal source including a closed loop geothermal circuit.

8. An apparatus for removing moisture from air comprising:

a refrigerant circuit including a first heat exchanger, a second heat exchanger, and a refrigerant stream movable along a first path between the first and second heat exchangers, the first heat exchanger operable in a first mode to transfer heat from the refrigerant stream to increase a temperature of an air stream flowing relative to the first heat exchanger;

a heat sink circuit including the second heat exchanger, a third heat exchanger, and a heat sink fluid stream movable along a second path from the second heat exchanger to the third heat exchanger, the second heat exchanger operable when in a first mode to transfer heat from the heat sink fluid stream to the refrigerant stream and for decreasing a temperature of the heat sink fluid stream, the third heat exchanger operable to receive the heat sink fluid stream from the second heat exchanger to transfer heat from the air stream adjacent the third heat exchanger to the heat sink fluid stream to condense water vapor in the air on the third heat exchanger, the third heat exchanger positioned upstream with respect to the air stream through the first heat exchanger when operating in the first mode; and means for mixing the heat sink fluid stream with glycol prior to the heat sink fluid stream entering the heat sink circuit, said heat sink circuit further comprising a fourth heat exchanger for exchanging heat between the heat sink fluid and water directed to the fourth heat exchanger from a pool; and a valve for directing the heat sink fluid stream to one of the third heat exchanger and the fourth heat exchanger.

9. The apparatus of claim 1 further comprising:

the refrigerant circuit including a fifth heat exchanger and operable in a second mode to transfer heat from the refrigerant stream to increase the temperature of a second heat sink fluid stream flowing relative to the fifth heat exchanger.

10. An apparatus for removing moisture from air comprising:

a refrigerant circuit including a first heat exchanger, a second heat exchanger, and a refrigerant stream movable along a first path between the first and second heat exchangers, the first heat exchanger operable in a first mode to transfer heat from the refrigerant stream to increase a temperature of an air stream flowing relative to the first heat exchanger;

a heat sink circuit including the second heat exchanger, a third heat exchanger, and a heat sink fluid stream movable along a second path from the second heat exchanger to the third heat exchanger, the second heat exchanger operable when in a first mode to transfer heat to the refrigerant stream from the heat sink fluid stream and decrease a temperature of the heat sink fluid stream, the third heat exchanger operable to receive the heat sink fluid stream from the second heat exchanger to transfer heat from the air stream adjacent the third heat exchanger to the heat sink fluid stream and remove water vapor from the air stream adjacent the third heat exchanger;

a conduit including an inlet and an outlet for the air stream, the third heat exchanger positionable in the conduit downstream of the inlet to define a first chamber therebetween, the first heat exchanger positionable in the conduit downstream of the third heat exchanger to define a second chamber therebetween, a second inlet communicating with the conduit adjacent the second chamber for introducing a second air stream to the second chamber to bypass the third heat exchanger; and means for controlling a flow of the second air stream through the second inlet, the controlling means operable with respect to the second inlet between an opened position and a closed position, the opened position corresponding to a minimal restriction of the flow and the closed position corresponding to a maximum restriction of the flow.

11. The apparatus of claim 10 further comprising:

the conduit including a third inlet communicating with the conduit adjacent the third chamber for introducing a third air stream to the second chamber to bypass the third heat exchanger and the first heat exchanger; and means for controlling a flow of the third air stream through the third inlet, the controlling means for controlling the flow of the third air stream operable with respect to the third inlet between an open position and a closed position, the open position corresponding to a minimal restriction of the flow of the third air stream and the closed position corresponding to a maximum restriction of the flow of the third air stream.

12. The apparatus of claim 11 further comprising:

a sensor for sensing a condition corresponding to a temperature of the heat sink fluid received by the third heat exchanger and emitting a signal corresponding to the sensed temperature; and an actuator for receiving the signal from the sensor and moving a damper operably associated with the second inlet.

13. The apparatus of claim 12 further comprising:

the heat sink fluid stream supplied from a geothermal source.

14. The apparatus of claim 12 further comprising:

means for mixing the heat sink fluid stream with glycol prior to the heat sink fluid stream entering the heat sink circuit.

15. A method for removing moisture from air comprising the steps of:

circulating a refrigerant stream along a refrigerant circuit including a first heat exchanger, a second heat exchanger, and a first path between the first and second heat exchangers, the first heat exchanger operable in a first mode to transfer heat from the refrigerant stream to increase a temperature of an air stream flowing relative to the first heat exchanger;

circulating a heat sink fluid stream along a heat sink circuit including the second heat exchanger, a third heat exchanger, and a second path from the second heat exchanger to the third heat exchanger, the second heat exchanger operable when in a first mode to transfer heat to the refrigerant stream from the heat sink fluid stream to decrease a temperature of the heat sink fluid stream, the third heat exchanger operable to receive the heat sink fluid stream from the second heat exchanger to transfer heat from the air stream adjacent the third heat exchanger to the heat sink fluid stream to condense water vapor in the air on the third heat exchanger, the third heat exchanger positioned upstream with respect to the air stream through the first heat exchanger when operating in the first mode;

positioning the first heat exchanger and the third heat exchanger in a conduit, the conduit including an inlet for receiving the air stream, an outlet for expelling the air stream, a first chamber defined in the conduit between the inlet and the third heat exchanger, a second chamber defined in the conduit between the third heat exchanger and the first heat exchanger, and a third chamber defined in the conduit between the first heat exchanger and the outlet, a second inlet communicating with the conduit adjacent the second chamber for introducing a second air stream to the second chamber to bypass the third heat exchanger; and controlling a flow of the second air stream through the second inlet with controlling means, the controlling means operable with respect to the second inlet between an opened position and a closed position, the opened position corresponding to a minimal restriction of the flow and the closed position corresponding to a maximum restriction of the flow.

16. The method of claim 15 further comprising the steps of:

communicating with the third chamber through a third inlet for introducing a third air stream to the second chamber to bypass the third heat exchanger and the first heat exchanger; and controlling a flow of the third air stream through the third inlet with controlling means, the controlling means for controlling the flow of the third air stream operable with respect to the third inlet between an opened position and a closed position, the opened position corresponding to a minimal restriction of the flow of the third air stream and the closed position corresponding to a maximum restriction of the flow of the third air stream.

17. The method of claim 15 further comprising the steps of:

supplying the heat silk fluid stream from a geothermal source.

* * * * *